US007389740B2

(12) United States Patent
Wishinsky

(10) Patent No.: US 7,389,740 B2
(45) Date of Patent: Jun. 24, 2008

(54) ACOUSTIC DEVICE

(76) Inventor: David Wishinsky, Road 413 KNO. 2, Rincon, PR (US) 00677

( * ) Notice: Subject to any disclaimer, the term of this patent is extended or adjusted under 35 U.S.C. 154(b) by 332 days.

(21) Appl. No.: 10/948,743

(22) Filed: Sep. 24, 2004

(65) Prior Publication Data

US 2006/0065475 A1 Mar. 30, 2006

(51) Int. Cl.
*G10K 9/04* (2006.01)

(52) U.S. Cl. ..... 116/142 FP; 116/142 R; 446/202

(58) Field of Classification Search ..... 116/142 FP, 116/137 R, 142 R, 140; 137/510; 446/202, 446/203, 204, 205, 206, 207, 208, 209, 397, 446/418; D10/120
See application file for complete search history.

(56) References Cited

U.S. PATENT DOCUMENTS

| | | | | | |
|---|---|---|---|---|---|
| 169,427 | A | * | 11/1875 | Duvall | 446/205 |
| 870,074 | A | | 11/1907 | Astrom | |
| 1,281,877 | A | | 10/1918 | Teste et al. | |
| 1,655,675 | A | | 1/1928 | Cunningham | |
| 1,661,525 | A | * | 3/1928 | Deerfoot | 446/208 |
| 1,676,528 | A | * | 7/1928 | Critchfield | 116/142 FV |
| 1,679,011 | A | | 7/1928 | Widmyer | |
| 1,822,674 | A | * | 9/1931 | Scofield et al. | 116/142 R |
| 2,370,939 | A | | 3/1945 | Cooney | |
| 2,386,513 | A | * | 10/1945 | Soderberg | 116/142 FP |
| 2,700,316 | A | * | 1/1955 | Gordon et al. | 84/330 |
| 2,918,895 | A | | 12/1959 | Buell | |
| 3,000,344 | A | | 9/1961 | Ferrell | |
| D215,978 | S | * | 11/1969 | Berns | D10/120 |
| 3,670,689 | A | | 6/1972 | Pappas | |
| 3,785,335 | A | | 1/1974 | Wagner | |
| 4,024,830 | A | | 5/1977 | Fegley et al. | |
| 4,116,158 | A | * | 9/1978 | Warnod | 116/142 R |
| 4,227,482 | A | | 10/1980 | Scheindel | |
| 4,252,077 | A | * | 2/1981 | Frigo | 116/142 FP |
| 4,401,049 | A | | 8/1983 | Bevillard | |
| 5,460,116 | A | | 10/1995 | Gyorgy | |
| 5,630,744 | A | * | 5/1997 | Bandy | 446/202 |
| 5,662,064 | A | | 9/1997 | Gyorgy | |
| 6,357,382 | B1 | * | 3/2002 | Clark | 116/137 R |
| 6,491,564 | B1 | * | 12/2002 | Miller | 446/202 |
| 6,881,121 | B1 | * | 4/2005 | Szekely | 446/213 |
| 2006/0150890 | A1 | * | 7/2006 | Cohen | 116/142 FP |
| 2006/0196405 | A1 | * | 9/2006 | Cohen | 116/142 FP |
| 2006/0201330 | A1 | * | 9/2006 | Cohen | 99/275 |
| 2006/0243190 | A1 | * | 11/2006 | Cohen | 116/137 R |

FOREIGN PATENT DOCUMENTS

| | | | | |
|---|---|---|---|---|
| DE | 4338633 | A1 | * | 5/1995 |
| DE | 29620253 | U1 | * | 4/1997 |
| EP | 539935 | A2 | * | 5/1993 |
| EP | 0 610 380 | B1 | | 8/1994 |
| ES | 2168192 | A | * | 6/2002 |
| GB | 2077019 | A | | 12/1981 |

* cited by examiner

*Primary Examiner*—R. A. Smith
(74) *Attorney, Agent, or Firm*—Edell, Shapiro & Finnan, LLC

(57) ABSTRACT

In an acoustic horn of the type wherein a resiliently flexible membrane is stretched across an edge of a tube and vibrated by pressurized fluid forced between the tube edge and a first surface of the membrane into the tube, a positionally adjustable end cap is disposed over the membrane to permit the frequency of vibration of the membrane to be adjusted as a function of the position of the end cap relative to the membrane. The end cap position selectively limits the amount of displacement of the membrane. In addition, the end cap positional adjustability permits selectively control of the force urging the membrane against the tube edge in opposition to the pressurized fluid.

27 Claims, 7 Drawing Sheets

ACOUSTIC DEVICE

FIELD OF THE INVENTION

The present invention relates to an acoustic device that generates sound via a vibrating membrane and, more particularly, to an acoustic device including a resiliently flexible membrane and a positionally adjustable end cap.

BACKGROUND

Horns that include a membrane to produce sound through vibration are generally known in the art. For example, U.S. Pat. No. 870,874 to Astrom, incorporated herein by reference in its entirety, discloses a horn including an outer vessel and an inner vessel concentrically disposed therein. A gap exists between the vessels, with the outer vessel connected to the inner vessel at the base of the outer vessel. A pipe having a channel in communication with the gap extends from the outer vessel. In addition, a countersunk cap holds a diaphragm tautly against the upper edges of the inner and outer vessels. In use, air is forced through the pipe, enters the gap and travels toward the diaphragm. The pressure caused by the airflow forces the diaphragm away from the edge of the inner vessel, which, in turn, allows the air to enter the inner vessel passageway. Once the air enters the passageway, it expands, increasing in velocity. This creates a low pressure region that pulls the diaphragm back toward the edge of the inner vessel. The diaphragm remains positioned against the edge of the inner vessel until the pressure from the airflow is again sufficient to force the diaphragm away from the edge. The process repeats in a cyclic manner for as long as the forced air is applied and drawn over the diaphragm, causing it to vibrate at audible frequencies, and produce sound.

U.S. Pat. No. 5,460,116 to Gyorgy, incorporated herein by reference in its entirety, discloses a horn including a sound tube coaxially surrounded by a pressure tube such that an annular gap exists between the tubes, the gap having a minimum clearance of 0.2 mm. A closing collar holds the tubes together at one end, while a membrane is stretched over the opposite ends. The membrane is held in place by a retaining ring that is force-fit into a step located on the exterior of the pressure tube. In use, air is forced through a lateral opening in the pressure tube. The air causes the membrane to vibrate, which, in turn, generates sound.

Similarly, U.S. Pat. No. 5,662,064, also to Gyorgy, incorporated herein by reference in its entirety, discloses a horn including a sound tube coaxially surrounded by a pressure tube such that a gap exists between the tubes. The upper end of the sound tube is set back from the upper end of the pressure tube. A membrane is stretched over the upper ends of the tubes. A ring secures the membrane to the pressure tube, disposing the membrane against the edge of the sound tube. In use, air is forced through a lateral opening in the pressure tube, causing the membrane to vibrate, which, in turn, generates sound.

While each of the horns described above provides certain efficiencies and advantages, there still exists a need to provide a horn that is small and lightweight, but is able to produce a sound having variable frequencies. The horns of Gyorgy, for example, lack an end cap. As a result, the sound produced is weaker, becoming lost in the noise pollution of the surrounding environment, such as that existing at an athletic event. In addition, none of the Gyorgy or Astrom horns includes an adjustable end cap configured to alter the nature of the sound produced by the horn (e.g., its frequency, tone, pitch, etc). Consequently, there exists a need to provide a portable, lightweight acoustic device capable of producing high volume sound, and which is further capable of producing sound having varying frequency.

This invention is directed generally to a handheld acoustic device including a membrane and a repositionable end cap disposed over the membrane. More specifically, this invention is directed toward an acoustic device including an end cap whose cover portion can be positioned at varying axial displacement relative to a membrane to alter the frequency of the sound produced by the device.

SUMMARY

Generally, the embodiments of the present invention provide an acoustic device and, more particularly, an acoustic device that includes an end cap that can be axially repositioned to adjust the characteristics of the sound produced by device such as frequency.

BRIEF DESCRIPTION OF THE DRAWINGS

Like reference numerals have been used to identify like elements throughout this disclosure.

DETAILED DESCRIPTION

Figure 1:
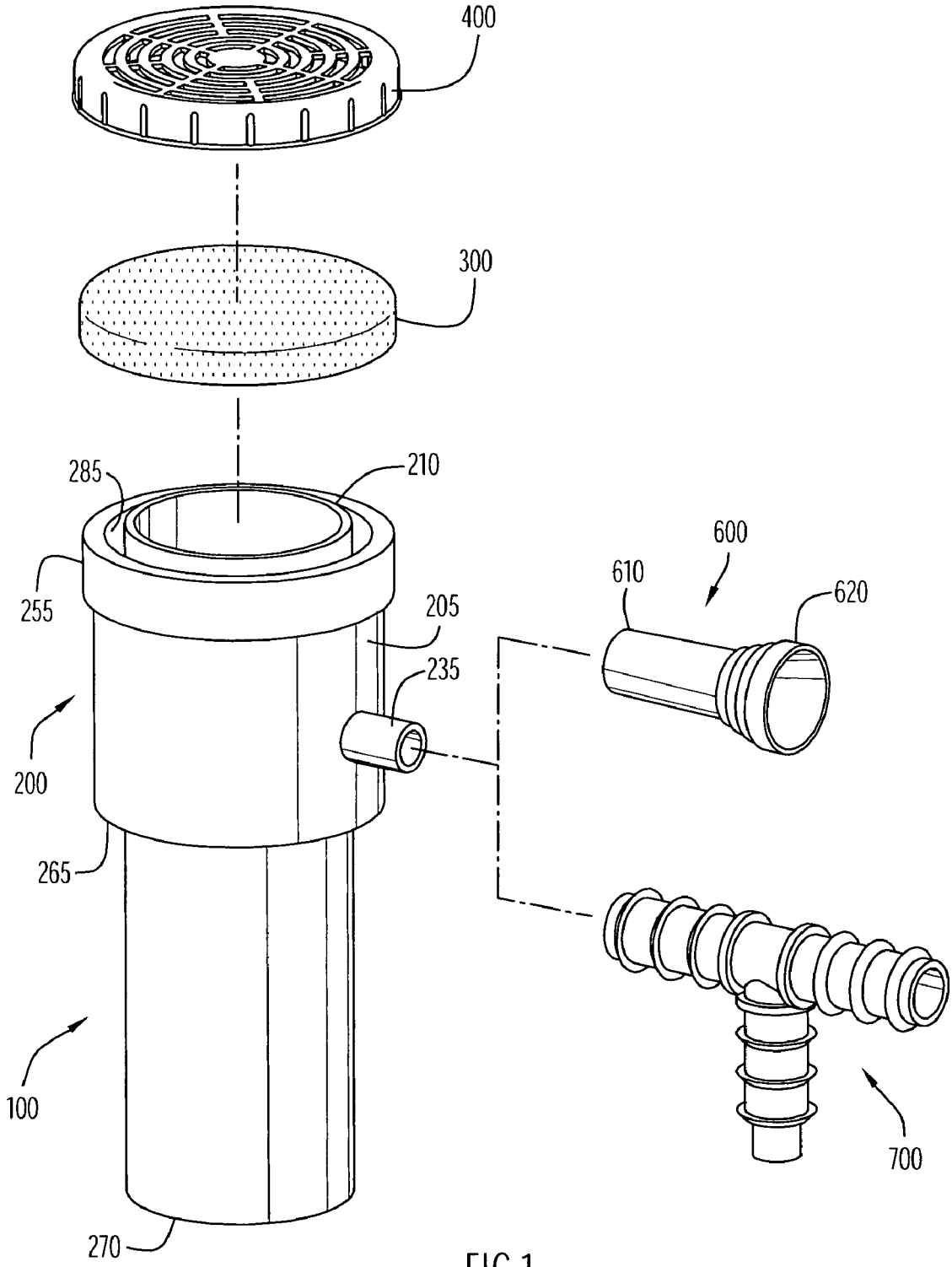
FIG. 1 illustrates an exploded perspective view of an acoustic device according to an embodiment of the invention, including T-connector and mouthpiece accessories.
Figure 2:
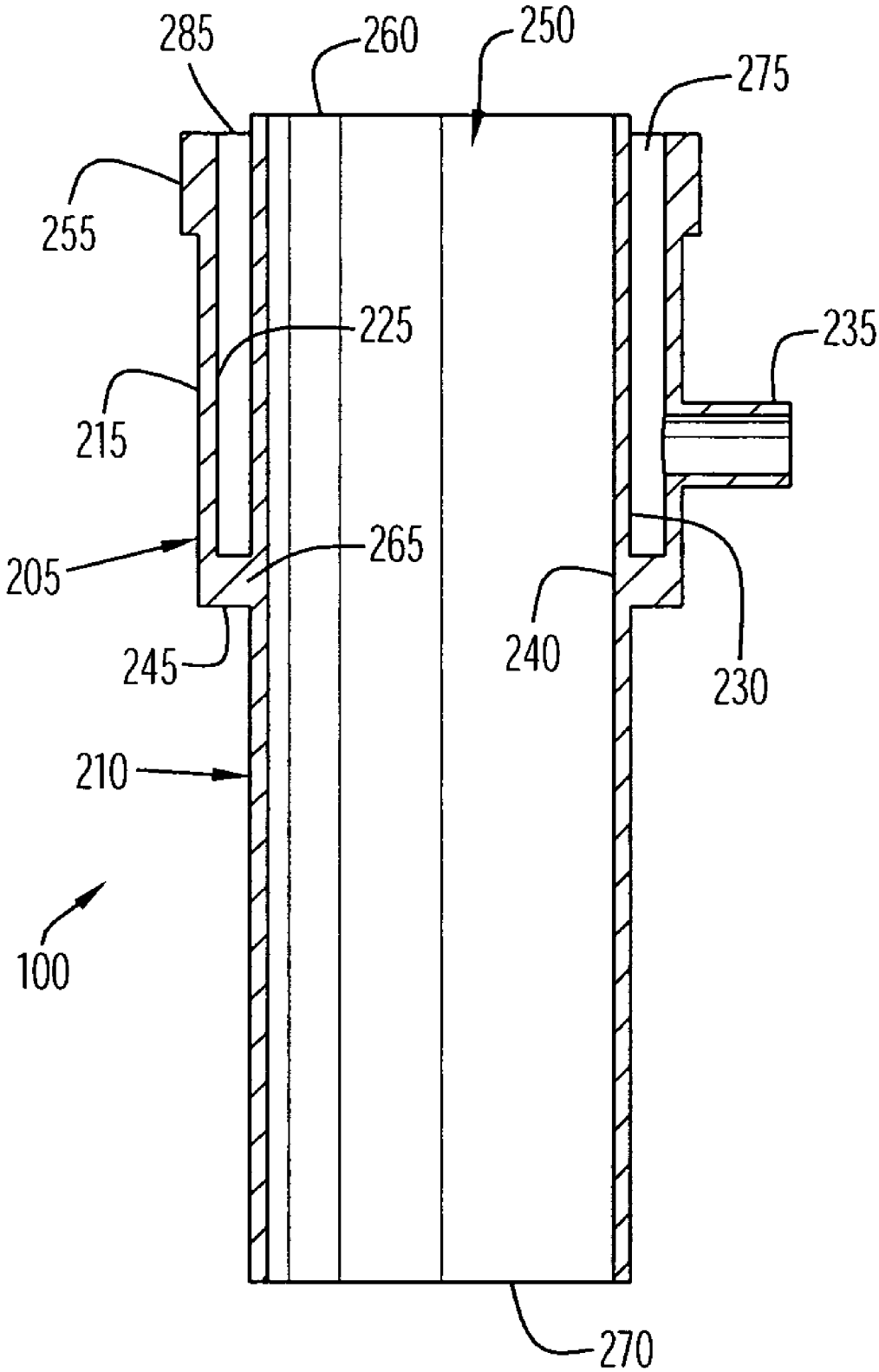
FIG. 2 illustrates a longitudinal cross-sectional view of the acoustic device of FIG. 1 showing the internal chambers of the device.
Figure 3:
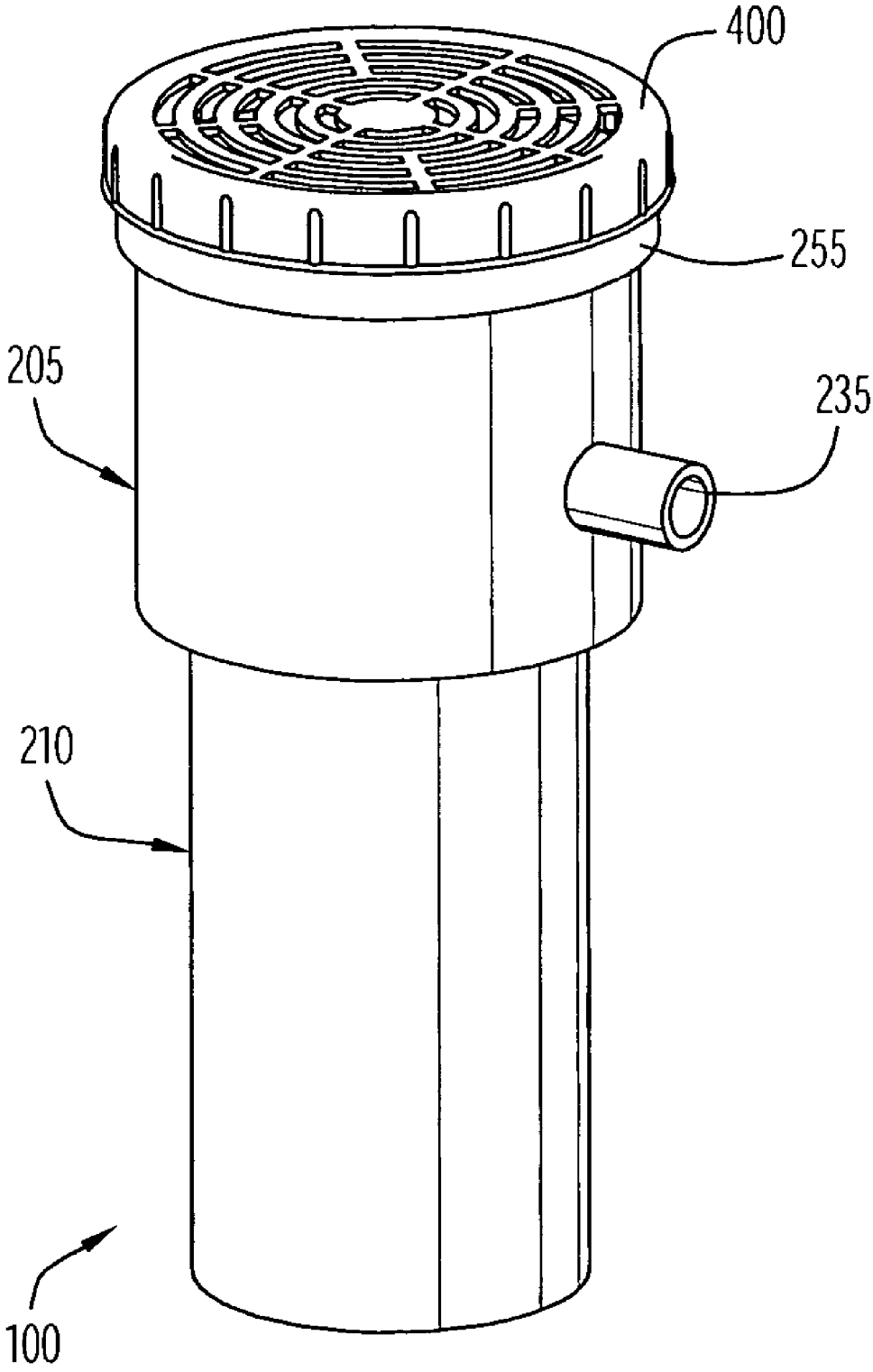
FIG. 3 illustrates a perspective view of the acoustic device of FIG. 1 showing attachment of the end cap.

An acoustic device (or horn or noisemaker) according to an embodiment of the invention is illustrated in FIGS. 1-3. The device 100 includes an acoustic member 200, a membrane 300, and an end cap 400. The device 100 may further include optional attachments such as a mouthpiece 600 and a T-connector 700.

The acoustic member 200 includes a short outer tube 205 and a longer inner tube 210 concentrically disposed and spaced to define a substantially annular gap 275 therebetween. Gap 275 is configured to direct a pressurized fluid (e.g., water or air) radially toward the outer portion of a membrane. The outer tube 205 is hollow and includes a substantially cylindrical shape with an exterior surface 215 and an interior surface 225. The interior surface 225 defines the outer boundary of gap 275, which extends from a first membrane-covered open end 285 to a second closed end 265. The diameter of tube 205 is not particularly limited; by way of example, for a small hand held device, the diameter may be in the range of approximately 2 cm to 5 cm, and preferably approximately 4 cm. Closed end 265 of gap 275 includes an annular shoulder 245 extending radially inward from the interior surface 225 of outer tube 205 to the exterior surface 230 of inner tube 210, providing the fluid tight seal at the closed end of the gap.

The exterior surface 215 of the outer tube 205 includes a radially enlarged lip 255 extending radially outward from the distal annular edge of membrane-covered end 285. As shown in FIG. 3, lip 255 functions an attachment location for both a membrane 300 and an end cap 400 (discussed below). An inlet port 235 extends transversely or radially outward from outer tube 205 and is configured to allow air to pass therethrough. Port 235 is a flow tube communicating between the ambient environment and annular gap 275 defined between tubes 205 and 210. The diameter of the port channel is not particularly limited. By way of example, the diameter may be in the range of approximately 3 mm to 5 mm, and is preferably approximately 4 mm. Port 235 includes dimensions sufficient to be received by and frictionally fit into one or more of the mouthpiece 600 and the connector 700 (FIG. 1). The location of port 235 along exterior surface 215 is not particularly limited, so long as port 235 is in communication with annular gap 275. By way of example, port 235 may be disposed at any circumferential location proximate the longitudinal center of the outer tube 205.

Inner tube 210 is substantially cylindrical and includes an exterior surface 230 and an interior surface 240 defining a substantially cylindrical channel 250 extending from a first membrane-covered open end 260 to a second open end 270. The diameter of channel 250 is not particularly limited; by way of example, it may be in the range of approximately 2 cm to 4 cm, and preferably is approximately 3 cm. Inner tube 210 is concentrically and coaxially disposed within the channel of outer tube 205. As discussed above, the diameter of inner tube 210 is smaller than and spaced from outer tube 205 to define annular gap 275 between the interior surface 225 of outer tube 205 and an exterior surface 230 of inner tube 210.

The inner tube 210 axial or length dimension is not particularly limited, and is typically greater than or coextensive with the axial length of outer tube 205. By way of example, both tubes 205, 210 may have lengths in the range of approximately 3 cm to 5 cm, and preferably have lengths of approximately 4 cm. In addition, inner tube 210 may extend beyond outer tube 205 at one or both ends. That is, the ends of outer tube 205 and inner tube 210 need not be coplanar. By way of example, inner tube 210 may extend beyond the membrane-covered end 285 of outer tube 205, as shown in FIGS. 1 and 2. The difference in length between the tubes at the membrane end is not particularly limited. By way of example, end 260 of inner tube 210 may extend beyond end 285 of the outer tube 205 by a range of approximately 0.05 mm to 0.3 mm.

Additionally, the second end 270 of inner tube 210 may extend beyond the closed end 265 of outer tube 205. Extending inner tube 210 beyond closed end 265 alters the pitch of the sound created by the acoustic device 100. Specifically, increasing the extension lowers the frequency of the sound produced by the device. The amount of extension is not particularly limited and may be a set length that provides a predetermined frequency. By way of example, the extension may be in the range of approximately 4 cm to 8 cm, and is preferably approximately 6 cm. In an alternative embodiment, the extension may be manually adjustable (not shown) to provide varying frequencies during use (e.g., similar to the slide of a trombone).

The membrane 300 includes a resiliently flexible sheet material configured to vibrate when positioned across the open ends of outer tube 205 and inner tube 210. It is further operable to generate sound when vibrated (i.e., it is configured to vibrate at audible frequencies). The material comprising the membrane is not limited, but is typically made of material capable of stretching across the ends of the tubes and vibrates as pressurized fluid is directed toward the membrane. By way of further example, the membrane is made of rubber, plastic, polyethylene terephthalate, polyvinyl chloride, paper, or similar materials having sufficient elastic and fluid impervious qualities to enable vibration. Membrane 300 includes a first, interior surface and a second, exterior surface. Membrane 300 is positioned over inner tube end 260 and outer tube end 285 (i.e., the membrane-covered ends). By way of specific example, membrane 300 may comprise an elastic sheet material stretched across outer 205 and inner 210 tubes such that it frictionally engages lip 255 of outer tube 205 and membrane first surface is oriented towards and/or contacts tube ends 260, 285. With this configuration, membrane 300 covers both inner tube channel 250 and annular gap 275, closing the gap at end 285. The size of membrane 300 is not particularly limited, but is preferably sized so that it is held tautly on outer tube 205 and rests in contact with inner tube 210. The level of tautness is not particularly limited, and may be altered to adjust the tone of the sound (the higher the degree of tautness, the higher the tone). Such frictional engagement, moreover, serves to secure membrane 300 to lip 255. The thickness of the membrane is not particularly limited and is chosen to provide sufficient resilience to function as described herein.

Figure 4:
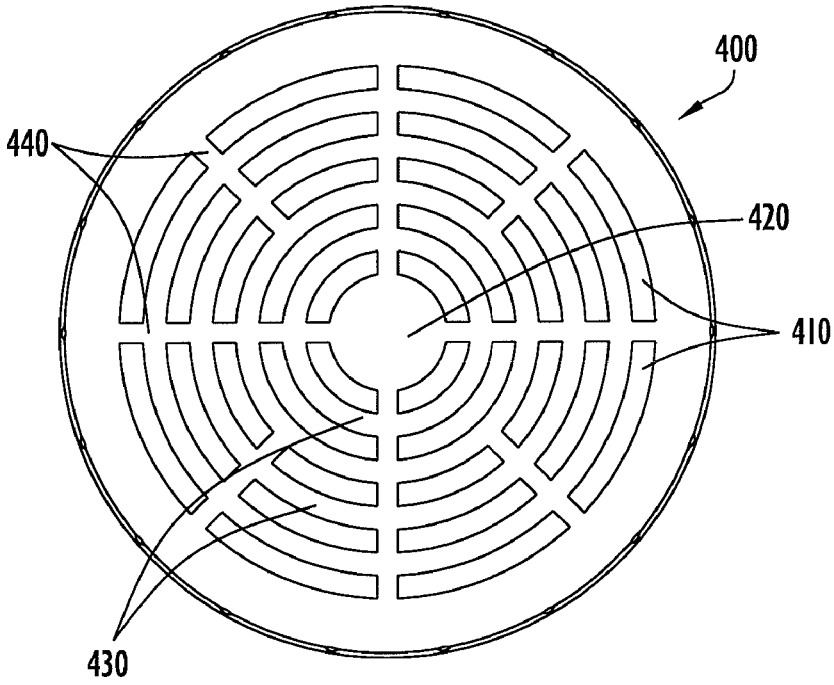
FIG. 4 illustrates a plan view of the end cap of FIGS. 1 and 3.

Acoustic device 100 further includes an end cap 400 positioned over membrane 300 (i.e., over membrane second surface). End cap 400 is configured to exert an adjustable force against membrane 300 and to retain membrane 300 against inner tube 210. In addition, end cap 400 is configured to secure membrane 300 to acoustic member 200, while protecting membrane 300 from damage caused by contact with foreign objects. Referring to FIGS. 3 and 4, end cap 400 includes a circular wall surrounded circumferentially by an annular edge wall. The circular wall is typically coextensive with outer tube diameter, serving as a protective cover portion. Circular wall typically includes a plurality of at least two apertures 410. In the preferred embodiment, apertures 410 are arranged in a pattern of concentric rings 430 about a central disc 420. Rings 430 are interrupted by radial spokes 440 that extend from disc 420 and intersect rings 430 to define multiple arcuate segments.

As shown best in FIGS. 1 and 3, the annular edge wall of cap 400 extends axially a short distance from the periphery of the cover portion. The edge wall enables the axially slidable engagement of end cap 400 to lip 255. The edge wall may optionally include a series of bosses (protrusions) to enhance gripping while facilitating removal of end cap 400 from acoustic device 100. The diameter of end cap 400 is not limited; preferably, it is sized to frictionally receive the membrane-covered lip 255 of acoustic member 200. With this configuration, end cap 400 secures membrane 300 to acoustic member 200. The material comprising end cap 400 is not limited, and preferably includes a resilient, flexible material. For example, the material comprising end cap 400 may be the same as or different from the material that comprises the acoustic member 200. By way of further example, end cap 400 may comprise polyvinyl chloride. In operation, the lipped end of acoustic member 200 is axially inserted into the open side of end cap 400.

Figure 5:
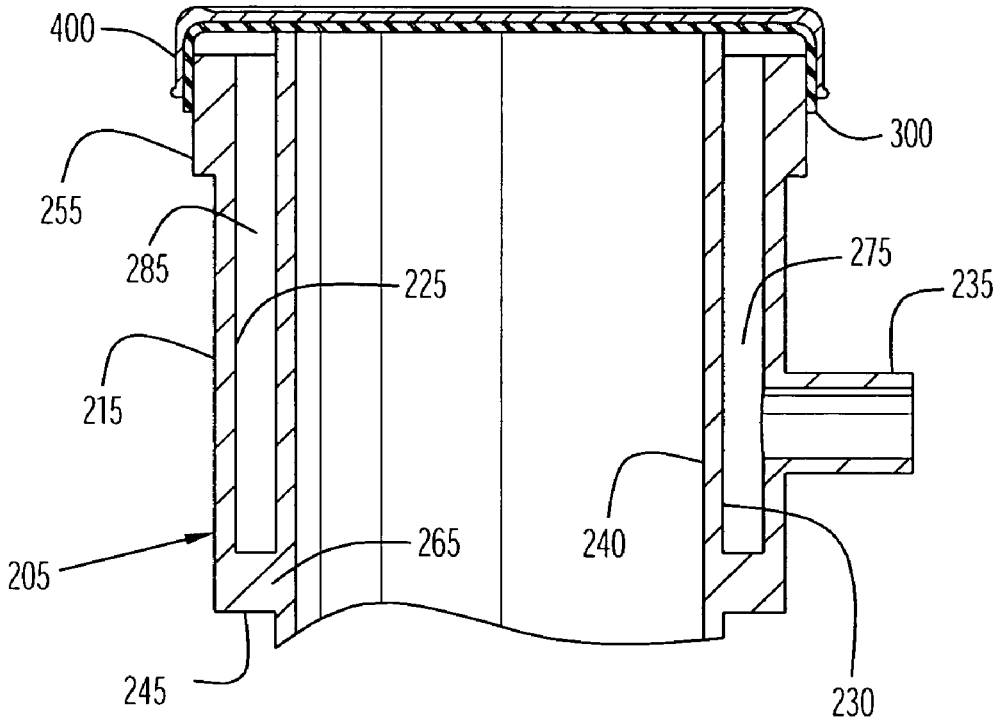
FIGS. 5 and 6 illustrate longitudinal cross-sectional views of one end of the acoustic device of FIG. 1 showing the membrane and the end cap, as well as the variable placement of the end cap with respect to the membrane.
Figure 6:
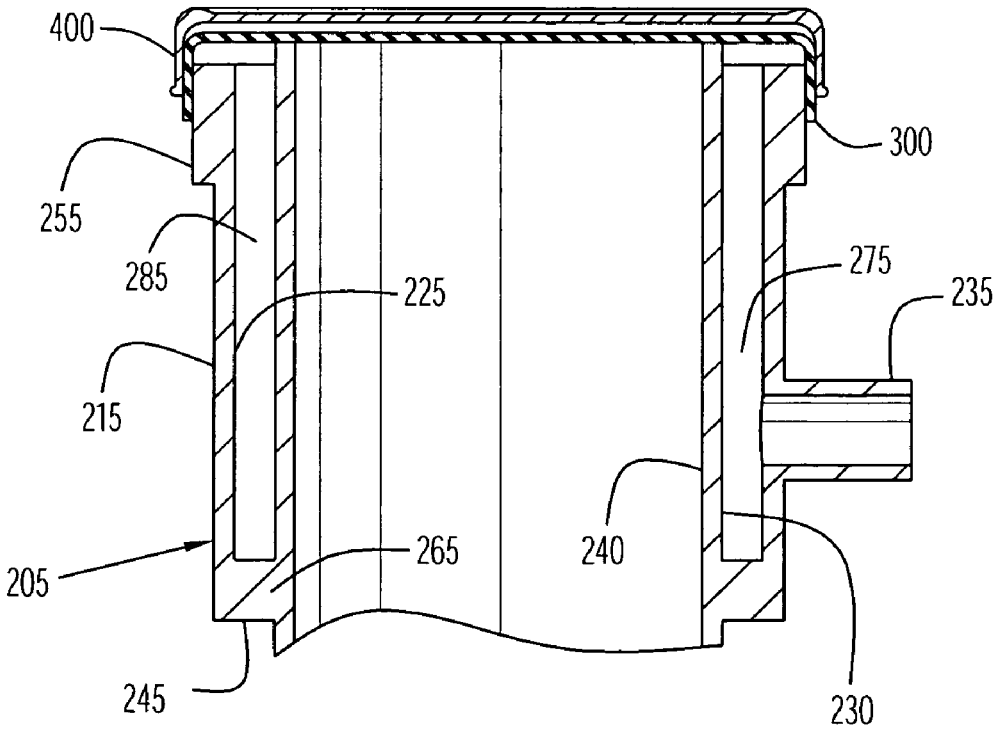

Operation of acoustic device 100 is described with reference to FIGS. 2, 5 and 6. At rest, membrane 300 is in its normal position, i.e., stretched across the end of device 100 such that it contacts the first end 260 of inner tube 210. A fluid under pressure, such as air blown from the mouth of a person, is forced through port 235, pressurizing gap 275. The pressure impacts on the first surface of membrane 300 and pushes it away from first end 260 of inner tube 210, permitting the air to enter inner tube channel 250. The air travels downstream along inner tube channel 250, expanding and increasing its velocity, so as to create a vacuum or low pressure region that draws membrane 300 back toward first end 260 of inner tube 210. Membrane 300 thus, once again, seals annular gap 275. As additional air is forced into port 235, the pressure in annular gap 275 becomes sufficient to overcome the low pressure created by aspiration in inner tube channel 250 and push membrane 300 away from first end 260. Consequently, as long as air pressurizes annular gap 275, membrane 300 will cyclically vibrate relative to opening 260 at audible frequencies. The vibration produces sound waves directed through inner tube channel 250 and out of acoustic device 100 via second end 270.

End cap 400, moreover, is operable to alter the frequency of the sound created by acoustic device 100. Specifically, the axial position of end cap 400 controls the degree of vibration of membrane 300 by controlling the distance membrane 300 can travel as pressurized fluid forces membrane 300 away from inner tube 210 (i.e., it controls the distance the membrane is displaced from its normal position). In addition, the axial position of end cap 400 determines the pressure in annular gap 275 required to displace membrane 300, thereby further affecting the frequency. Referring to FIGS. 5 and 6, as discussed above, end cap 400 is axially inserted over lip 255 of outer tube 205. The depth at which the circular wall of end cap 400 is set over membrane 300 is variable. By way of example, end cap 400 may be set at a depth such that the circular wall directly contacts membrane 300 in its normal position (FIG. 5); alternatively, end cap 400 may be set at a depth such that the circular wall is positioned above membrane 300 (i.e., such that the circular wall does not directly contact membrane 300) (FIG. 6). A range of end cap positions exists whereby the cap exerts different force levels urging the membrane against the device. This, in turn, limits the extent of vibration of membrane 300. Consequently, by adjusting the cap position and thus the force the cover portion exerts on the membrane, the frequency of the sound is controlled.

Figure 7:
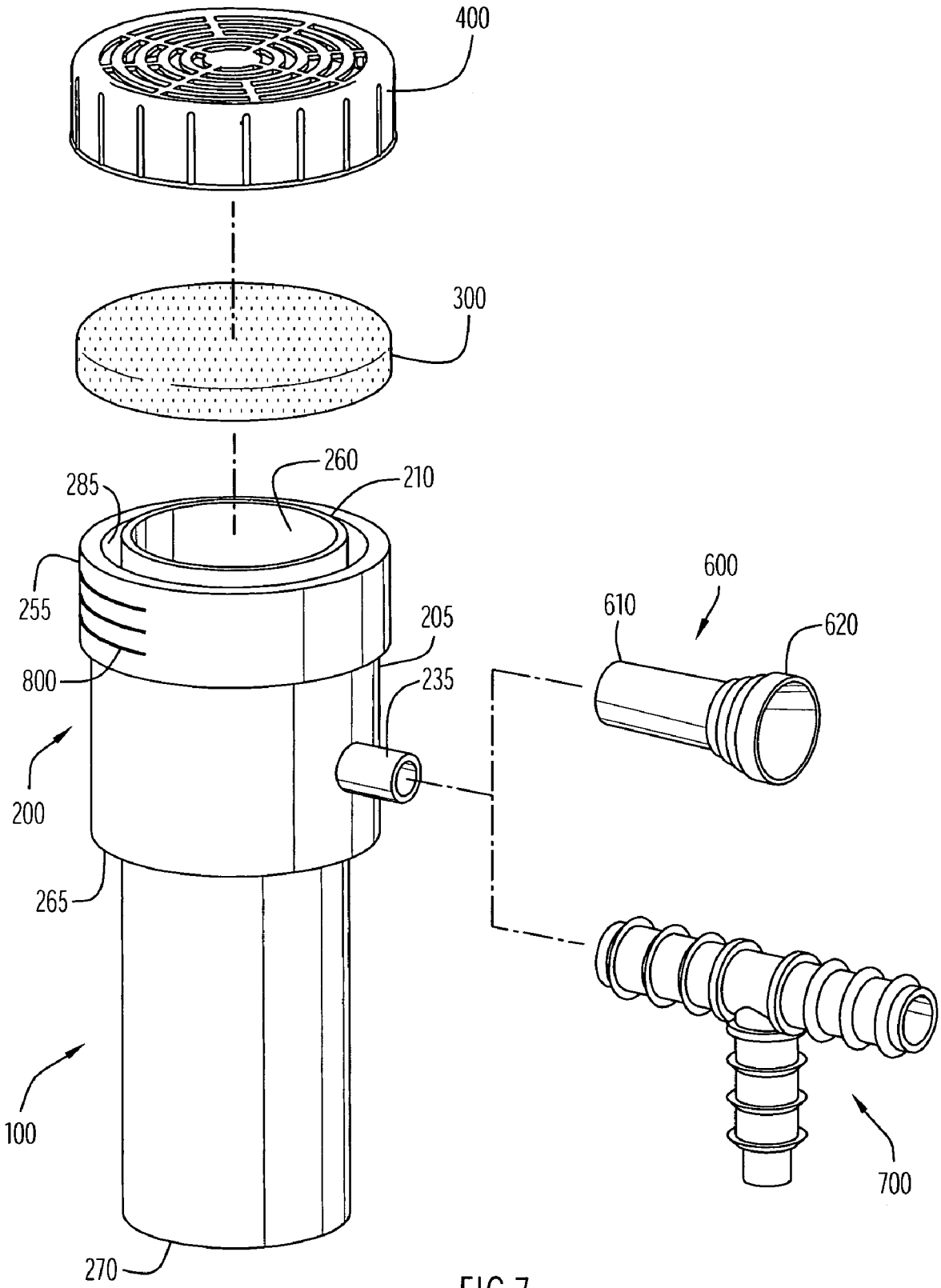
FIG. 7 illustrates an exploded perspective view of an acoustic device according to another embodiment of the invention, wherein device further includes guide marks.

Another embodiment of the invention assists a user in adjusting the nature of the sound emanating from acoustic device 100 via end cap 400. FIG. 7 illustrates an exploded perspective view of acoustic device 100 wherein lip 255 includes at least one guide mark 800 operable to direct a user to place end cap 400 along lip 255 at one or more predetermined axial positions. In another embodiment, guide marks 800 may be positioned on the portion of membrane 300 that extends over lip 255. In still another embodiment, guide marks 800 may be positioned along the exterior or interior of the edge wall of end cap 400. If guide marks 800 are located along membrane 300 or along edge wall, the edge wall preferably possesses transparency sufficient to view marks 800 through the cap edge wall. Similarly, when guide marks 800 are positioned along either lip 255 or the portion of membrane 300 that extends over lip 255, both the edge wall and membrane 300 are preferably generally transparent. The number and/or placement of guide marks 800 are not limited. Preferably, guide marks 800 are a series of continuous or discontinuous lines set at predetermined intervals. The distance between marks 800 is not limited, and may be positioned to provide desired frequency changes. In use, when guide marks 800 are placed on lip 255, the bottom of the end cap edge wall (i.e., the portion of the edge wall situated furthest from the circular wall) is visually aligned with the desired guide mark 800. Alternatively, when guide marks 800 are positioned along the end cap edge wall, the desired guide mark 800 may be visually aligned with either membrane end 260, 285. In yet another embodiment, no guide marks 800 are present, and the user manually adjusts end cap 400 by visual alignment. Once end cap 400 is set to the desired position, the user operates the device as described above.

Referring again to FIG. 1, acoustic device 100 may further include optional attachments. As shown, device 100 may further include a mouthpiece 600 having a distal end 610 and a proximal end 620. Mouthpiece 600 includes a funnel-like proximal end 620 converging into a generally cylindrical tube having a distal end 610 adapted to frictionally receive either port 235 or a fitting 740 (FIG. 8) of a T-connector 700 (described below). In use, a user axially inserts port 235 into distal end 610 of mouthpiece 600 and then generates pressurized fluid, e.g., by blowing air into proximal end 620 of mouthpiece 600.

Figure 8:
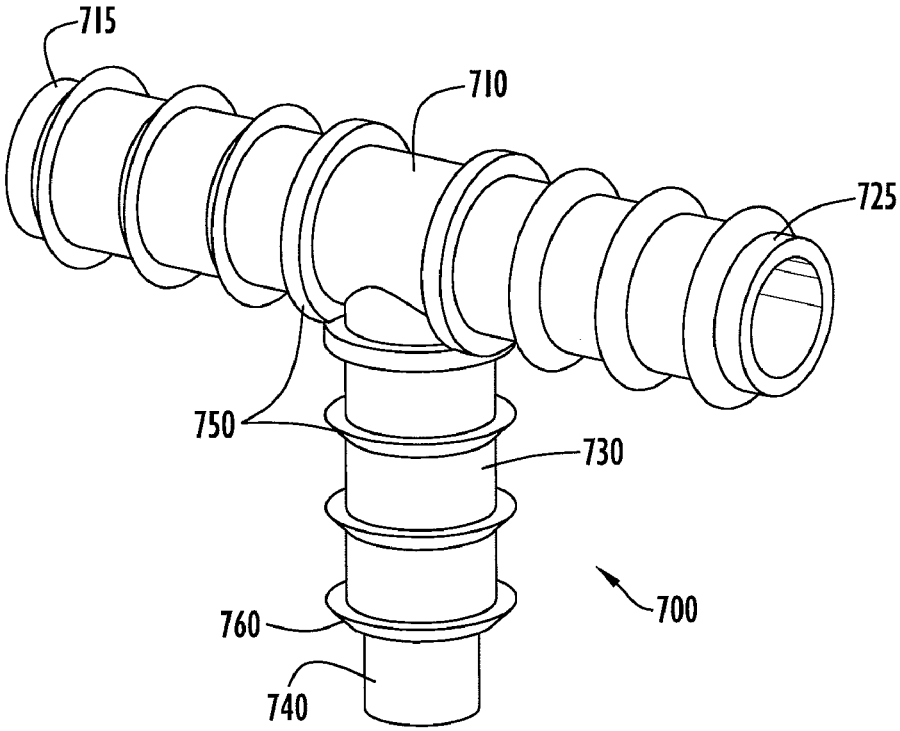
FIG. 8 illustrates a perspective view of the T-connector of FIG. 1.

The acoustic device 100 may further include a T-connector 700 configured to interconnect a plurality of acoustic devices 100 together, as well as to enable the substantially simultaneous use of those devices. Referring to FIG. 8, T-connector 700 includes a substantially cylindrical crosspiece 710 and a substantially cylindrical stem 730 in flow communication with and extending from the center of crosspiece 710. Crosspiece 710 includes an internal flow channel extending from its opposite ends 715 and 725. Opposite ends 715, 725 are adapted to receive port 235 of acoustic device 100. The outer surface of connector 700 may further include a series of ridges or protrusions 750 to facilitate gripping of T-connector 700, as well as to increase the structural integrity of the crosspiece 710 and stem 730.

Stem 730 defines a substantially cylindrical channel extending from crosspiece 710 to a terminal fitting 740. The channel of stem 730 is in flow communication with the channel of crosspiece 710. Fitting 740 is adapted to be inserted into distal end 610 of mouthpiece 600. A ridge 760 located proximate fitting 740 may serve as a stop for mouthpiece 600 when fitting 740 is inserted into mouthpiece distal end 610.

Figure 9:
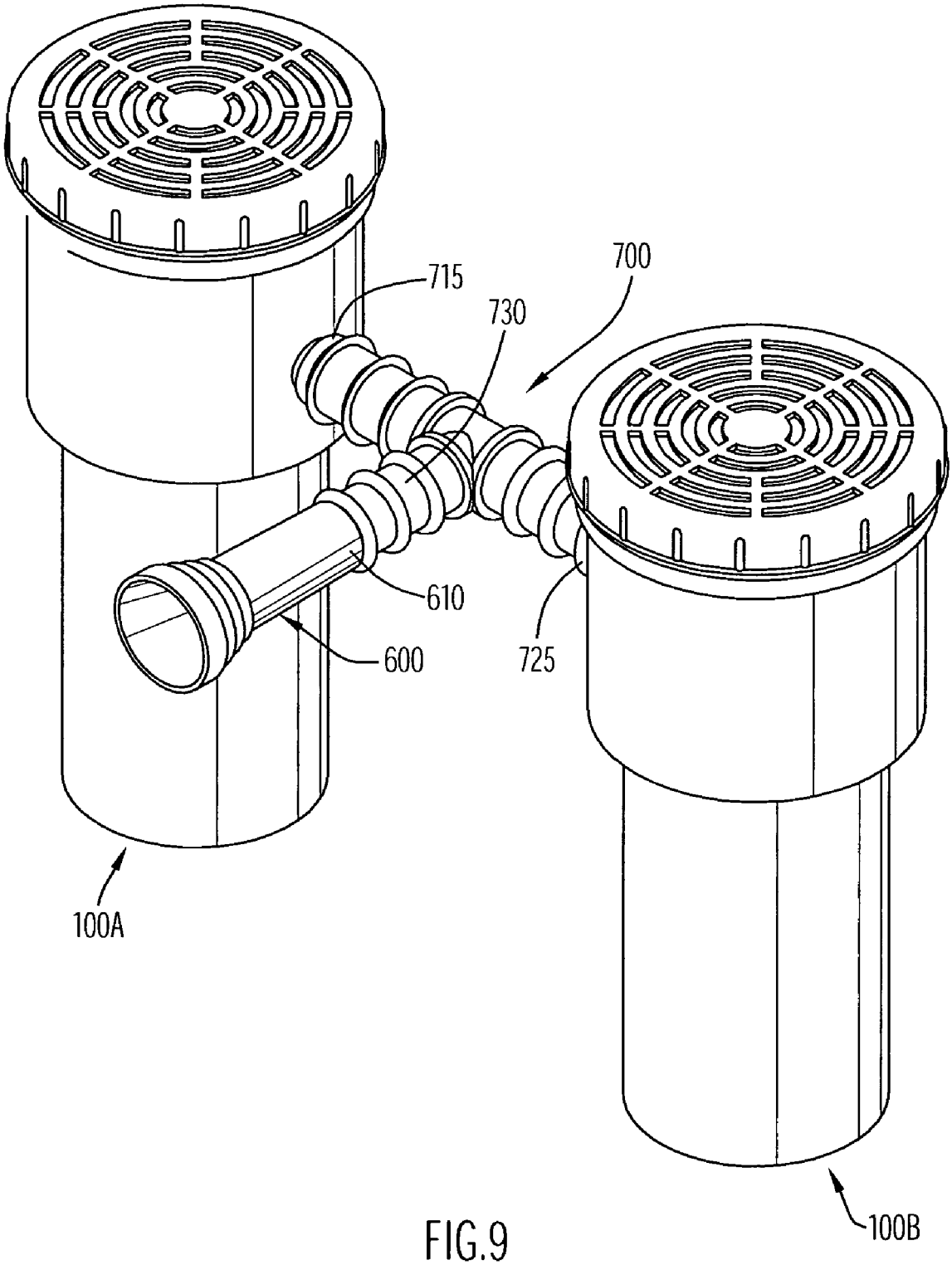
FIG. 9 illustrates a perspective view of the acoustic device of FIG. 1 attached to a second acoustic device via the connector of FIG. 8.

Another operational embodiment of the acoustic device is described with reference to FIG. 9. As shown, the inlet port of a first acoustic device 100A is axially inserted into one end 715 of crosspiece 710. Similarly, the port of a second acoustic device 100B is axially inserted into to the other end 725 of cross-piece 710. Finally, fitting 740 is axially inserted into distal end 610 of mouthpiece 600. In operation, a user may blow air into mouthpiece 600 to activate both devices 100A, 100B substantially simultaneously (i.e., to generate sound in each device the manner described above).

It is to be understood that terms such as "top", "bottom", "front", "rear", "side", "height", "length", "width", "upper", "lower", "higher", "interior", "exterior", and the like as may be used herein, merely describe points of reference and do not limit the present invention to any particular orientation or configuration.

While the invention has been described in detail and with reference to specific embodiments thereof, it will be apparent to one skilled in the art that various changes and modifications can be made therein without departing from the spirit and scope thereof. For example, any fluid that generates pressure may be used to activate the device, including gases such as air and fluids such as water. A user may blow directly into the port, or use the mouthpiece or T-connector to generate a flow of air. In addition, mechanical means may be used to generate pressurized fluid.

The acoustic device may comprise any suitable material. It may include any shape or size. The outer or inner tubes may comprise any suitable material. The tubes include any size and shape, including shapes other than those that are annular or cylindrical (e.g., squares, rectangles, etc). The tubes may be coextensive, of the ends of the tubes may lack coplanarity. The diameter of the inner tube channel and outer tube channel may be of any size and shape, so long as the inner tube can be concentrically disposed in the outer tube channel. The annular gap between the inner and outer tubes may comprise any size and shape. The term annular is intended to include circular and noncircular shapes. The lip extending around the periphery of the outer tube may be of any shape and size; moreover, it may extend partially or completely along the exterior wall of the outer tube. The port may comprise any size and shape, and may be placed along any point of the outer tube, so long as the port channel is in communication with the annular gap.

The membrane may comprise any suitable material capable of vibration and having sufficient imperviousness to fluid. It includes any size and shape, and may be permanently or removably attached from the acoustic device.

The end cap may comprise any suitable material capable of being resiliently flexible. It may comprise any size and shape, and may be permanently or removably attached to the acoustic device.

The T-connector may comprise any suitable material and include any size and shape, including those other than a "T" shape (e.g., V-shaped, etc.). The T-connector, moreover, may include any number of connection points.

The stem may comprise any suitable material. It may include any size and shape, and may be located proximate the center of the crosspiece, or placed at any point along the crosspiece. Any number of acoustic devices may be interconnected to enable their substantially simultaneous use.

The mouthpiece may comprise any suitable material and include any size and shape operable to direct air into the port or the T-connector.

Thus, it is intended that the present invention covers the modifications and variations of this invention that come within the scope of the appended claims and their equivalents.

I claim:

1. In an acoustic device wherein a resiliently flexible membrane having a first surface and a second surface is stretched across an edge of a tube and vibrated by pressurized fluid forced between said tube edge and said first membrane surface, an improvement comprising: a positionally adjustable member disposed proximate said second surface of said membrane to permit the frequency of vibration of said membrane to be adjusted as a function of the position of said member relative to said membrane, wherein the positionally adjustable member comprises an end cap including an edge wall operable to slidably engage an exterior surface of the acoustic device such that the positionally adjustable member is selectively translatable along the tube from a first member position to a second member position.

2. The device of claim 1, wherein said positionally adjustable member is capable of plural positions relative to said membrane, and wherein displacement of said membrane during vibration is limited to a different extent for each of said plural positions.

3. The device of claim 1, wherein said positionally adjustable member exerts force on said membrane second surface, urging said membrane first surface against said tube edge in opposition to said pressurized fluid, and wherein said member has plural positions relative to said membrane in which said force is different for each of said positions.

4. The device of claim 1, wherein:

the tube comprises:

an outer tube including an interior surface and an exterior surface, and an inner tube including an interior surface and an exterior surface;

said inner tube is substantially coaxially disposed within said outer tube to define a generally annular gap between said exterior inner tube surface and said interior outer tube surface;

said membrane is stretched across said annular gap; and the edge wall of the positionally adjustable member frictionally engages the exterior surface of the outer tube.

5. The device of claim 4, wherein said outer tube includes a first open end and a second closed end, and said inner tube includes a first open end and a second open end;

and wherein said membrane is stretched across each of said inner tube first open end and said outer tube first open end such that said first membrane surface is oriented toward said inner tube first open end.

6. The device of claim 5, wherein said inner tube open ends extend beyond said outer tube ends.

7. The device of claim 4 further including a port extending radially outward from said outer tube exterior surface, wherein said port includes a flow channel in communication with said annular gap.

8. The device of claim 7 further including a connector configured to attach to said port, wherein said connector is operable to connect a plurality of said acoustic devices together and to enable substantially simultaneous use of said devices.

9. The device of claim 8, wherein said connector comprises T-connector having a crosspiece and a stem in flow communication with said crosspiece.

10. The device of claim 7 further including a mouthpiece configured to attach to said port, said mouthpiece comprising a funnel-shaped proximal end converging into a generally cylindrical tube having a distal end.

11. The device of claim 1, wherein said positionally adjustable member comprises a wall having a plurality of apertures, and said edge wall extends transversely from said wall with apertures.

12. The device of claim 11, wherein said wall is circular and said apertures include a plurality of concentric rings interrupted by radial spokes extending from a central disc.

13. The device claim 1, wherein:

the flexible membrane comprises a generally cup-shaped structure including a base and a side wall extending transversely about a perimeter of the base, and the membrane side frictionally engages the exterior surface of the acoustic device.

14. The device of claim 1, wherein the positionally adjustable member is translatable along an axis of the tube from the first member position to the second member position.

15. A method of generating sound in an acoustic device, the method comprising:

providing an acoustic device including a resiliently flexible membrane comprising a generally cup-shape structure including a base and a side wall extending transversely from a perimeter of the base, the base including a first surface and a second surface;

stretching the membrane across an edge of a tube such that the membrane side wall engages an exterior surface of the tube, vibrating the membrane by forcing pressurized fluid between said tube edge and said first membrane surface and into said tube; and selectively positioning an adjustable member proximate said second membrane surface to permit the frequency of vibration of said membrane to be adjusted as a function of the position of said member relative to said membrane, wherein the positionally adjustable membrane comprises an end cap including an edge wall operable to slidably engage an exterior surface of the acoustic device such that the positionally adjustable member is selectively translatable along the tube from a first member position to a second member position.

16. The method of claim 15, wherein said step of selectively positioning further includes:

arranging said adjustable member in plural positions relative to said second membrane surface to selectively limit the displacement of said membrane during vibration, wherein displacement of said membrane during vibration is limited to a different extent for each of said plural positions.

17. The method of claim 15, wherein said step of selectively positioning further includes:

positioning said adjustable member to exert a force on said membrane second surface and urge said membrane first surface against said tube edge in opposition to said pressurized fluid, wherein said member has plural positions relative to said membrane, and wherein said force differs for each of said positions.

18. The method of claim 15, wherein:

said tube comprises an outer tube including an interior surface and an exterior surface, and an inner tube including an interior surface and an exterior surface; and the method further comprises:

disposing said inner tube substantially coaxially within said outer tube to define a generally annular gap between said exterior inner tube surface and said interior outer tube surface, and stretching said membrane across said annular gap.

19. The method of claim 18, wherein said outer tube includes a first open end and a second closed end, and said inner tube includes a first open end and a second open end; and wherein the method further comprises the step of stretching said membrane across both of said inner tube first open end and said outer tube first open end such that said membrane first surface is oriented towards said inner tube first open end.

20. The method of claim 18, wherein said device further includes a port extending radially outward from said outer tube exterior surface, and a flow channel in communication with said annular gap; and wherein the method further includes the step of directing pressurized fluid through said port and into said annular gap.

21. The method of claim 20, wherein said device further includes a connector configured to attach to said port, and wherein the method further includes the steps of connecting a plurality of said acoustic devices together and directing said pressurized fluid through said connector.

22. The method of claim 20, wherein said device further includes a mouthpiece comprising a funnel-shaped proximal end converging into a generally cylindrical tube having a distal end, and wherein the method further includes the steps of attaching said distal end to said port and directing said pressurized fluid through said mouthpiece.

23. An acoustic device comprising:

an outer tube including an exterior surface, and an interior surface that defines a channel extending from a first open end to a second closed end;

an inner tube including an exterior surface, and an interior surface that defines a channel extending from a first open end to a second open end, wherein said inner tube is substantially coaxially disposed within said outer tube to define a generally annular gap between said outer tube interior surface and said inner tube exterior surface;

a membrane operable to vibrate at audible frequencies including a first surface and a second surface, wherein said membrane first surface contacts said first open ends of said tubes; and a repositionable member disposed over said membrane second surface, wherein said member is operable to adjust the frequency of vibration of said membrane and wherein the repositionable member comprises a generally cup-shaped structure including a base and a side wall extending transversely from a perimeter of the base, wherein the side wall of the repositionable member engages the outer tube exterior surface such that the repositionable member is selectively translatable along the outer tube exterior surface from a first member position to a second member position.

24. The device of claim 23 further including a port extending radially outward from said outer tube exterior surface, wherein said port includes a flow channel in communication with said annular gap.

25. A method of using the device of claim 24, comprising, directing air into said port to cause said membrane to vibrate at a first audible frequency;

adjusting the position of said repositionable member; and directing air into said port to cause said membrane to vibrate at a second audible frequency.

26. The device of claim 23, wherein:

the membrane comprises a generally cup-shaped structure including a base and a side wall extending transversely from a perimeter of the base, and the membrane side wall frictionally engages the exterior surface of the outer tube.

27. The device of claim 23, wherein the base includes apertures defined by a plurality of concentric rings interrupted by radial spokes extending from a central disc.

* * * * *